US011235917B1

(12) United States Patent
Kulkin et al.

(10) Patent No.: US 11,235,917 B1
(45) Date of Patent: Feb. 1, 2022

(54) SUSTAINABLE PACKAGING SYSTEM AND PACKAGING SEALING DEVICE

(71) Applicant: SSTEL LLC, Wilmington, DE (US)

(72) Inventors: Wayne Kulkin, Jackson, WY (US); Daniele Michetti, New York, NY (US)

(73) Assignee: SSTEL LLC, Wilimington, DE (US)

( * ) Notice: Subject to any disclaimer, the term of this patent is extended or adjusted under 35 U.S.C. 154(b) by 9 days.

(21) Appl. No.: 17/011,280

(22) Filed: Sep. 3, 2020

(51) Int. Cl.
*B65D 63/10* (2006.01)
*B65D 45/28* (2006.01)

(52) U.S. Cl.
CPC ..... *B65D 63/1072* (2013.01); *B65D 45/28* (2013.01); *B65D 2563/101* (2013.01)

(58) Field of Classification Search
CPC ..... B65D 63/1072; B65D 45/28; B65D 2563/101
See application file for complete search history.

(56) References Cited

U.S. PATENT DOCUMENTS 1,192,152 A * 7/1916 Atkinson ..... B65D 63/10 24/17 R
1,654,764 A * 1/1928 Traynick ..... B65D 63/14 24/18
3,330,409 A * 7/1967 Jorgensen ..... B65D 63/10 206/83.5
5,079,803 A * 1/1992 Moore ..... B65D 65/466 24/16 R
2017/0050786 A1 2/2017 Kozminkse

FOREIGN PATENT DOCUMENTS

| | | | |
|---|---|---|---|
| CN | 211377429 | U | 8/2020 |
| DE | 19716864 | A1 | 11/1998 |
| ES | 2363356 | A1 | 2/2011 |
| JP | 2006189014 | A | 6/2006 |

* cited by examiner

*Primary Examiner* — David M Upchurch
(74) *Attorney, Agent, or Firm* — Andrew F. Young; Nolte Lackenbach Siegel

(57) ABSTRACT

A packaging system and device that includes a container generally defining a rectangular prism configuration, the container including a receptacle including five walls and an opening and a lid that includes a first wall that is configured to cover the opening and four remaining walls that fit around four of the five walls of the receptacle, wherein the container defines a lengthwise direction and widthwise direction, a band that is secured the lengthwise direction of the container and a cable tie fastener that is configured to be secured about the widthwise direction of the container.

5 Claims, 6 Drawing Sheets

SUSTAINABLE PACKAGING SYSTEM AND PACKAGING SEALING DEVICE

BACKGROUND OF THE INVENTION

Field of the Invention

The present invention relates generally to a packaging sealing device and packaging system, and more particularly to a sustainable packaging device and system.

Description of the Related Art

Packaging refers to systems and devices for enclosing or protecting products for distribution, storage, sale, and/or use. Sustainable packaging refers to a type of packaging that results in improved sustainability as compared to more conventional packaging. Sustainable packaging result in a relatively reduced environmental impact and ecological footprint because they use less material and/or less environmentally harmful materials.

It is to be understood that this background section is provided to facilitate and understanding of the present invention and nothing discussed in here should be construed as any admission of prior art. The present invention overcomes at least some of the challenges that are discussed hereinabove by way of background.

ASPECTS AND SUMMARY OF THE INVENTION

A packaging sealing device may include: a band configured to be secured around a box in a first direction of the box; and a cable tie fastener that includes a length of material that includes male member at a distal end of the length of material and a female member secured to a portion of the length of material, the male member being configured to be secured to the female member such that the length of material is tightenable about the box in a second direction that is orthogonal relative to the first direction, and wherein the band includes a first opening and a second opening, the length of material of the cable tie fastener being received through the first opening and the second opening, thereby securing the length of material of the cable tie fastener to the band.

A packaging sealing device may include: a band configured to be secured around a box in a first direction of the box; and a cable tie fastener that includes a length of material that includes male member at a distal end of the length of material and a female member secured to a portion of the length of material, the male member being configured to be secured to the female member such that the length of material is tightenable about the box in a second direction that is orthogonal relative to the first direction, and wherein the band includes a first opening and a second opening, the length of material of the cable tie fastener being received through the first opening and the second opening, thereby securing the length of material of the cable tie fastener to the band. The band may include a first opening and a second opening; and a portion of the length of material of the cable tie fastener extends through the first opening and the second opening of the band with the portion of the length of material of the cable tie fastener being substantially orthogonal relative to a portion of the band through which the first opening and the second opening are disposed. The band may be transitionable from a first dimension to a second dimension, the second dimension substantially approximating a girth of the box, wherein the band is substantially at a maximum dimension when in the second dimension, the band being biased toward the first dimension, the first dimension being less than the second dimension. The length of material of the cable tie fastener may be substantially inelastic in a lengthwise direction. The male member of the length of material may be translatable through the female member in only one direction. A transparent sleeve may be coupled to at least one of the band and the fastener so that mailing labels or receipts or the like may be placed within the sleeve. The sleeve may be sealable after inserting such labels or receipts therein.

A packaging system may include: a container generally defining a rectangular prism configuration, the container comprising: a receptacle including five walls and an opening; and a lid that includes a first wall that is configured to cover the opening and four remaining walls that fit around four of the five walls of the receptacle, wherein the container defines a lengthwise direction and widthwise direction; a band that is secured the lengthwise direction of the container; and a cable tie fastener that is configured to be secured about the widthwise direction of the container. The packaging system may include a box or container and the packaging sealing device as disclosed herein.

The above and other aspects, features and advantages of the present disclosure will become apparent from the following description read in conjunction with the accompanying drawings, in which like reference numerals designate the same elements.

BRIEF DESCRIPTION OF THE DRAWINGS

A further understanding of the present disclosure can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENTS

As required, a detailed illustrative embodiment of the present invention is disclosed herein. However, techniques, systems, compositions and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

As shown in FIGS. 1-5, a packaging sealing device 100 may include a fastener 102. The fastener 102 may be a cable tie or a zip-tie and a band 104. The band 104 may include a first opening 104*x* and a second opening 104*y*. A distal end 102*a* of the fastener 102 may pass through the first opening 104*x* and the second opening 104*y* such that a length of material of the fastener 102 may pass through the band 104 (FIG. 4) such that the fastener 102 is substantially secured at a midpoint section of the band 104 when placed on the box to inhibit removal of either of the fastener 102 or the band 104 from the box when the packaging seal device 100 is secured to the box B.

Figure 5:
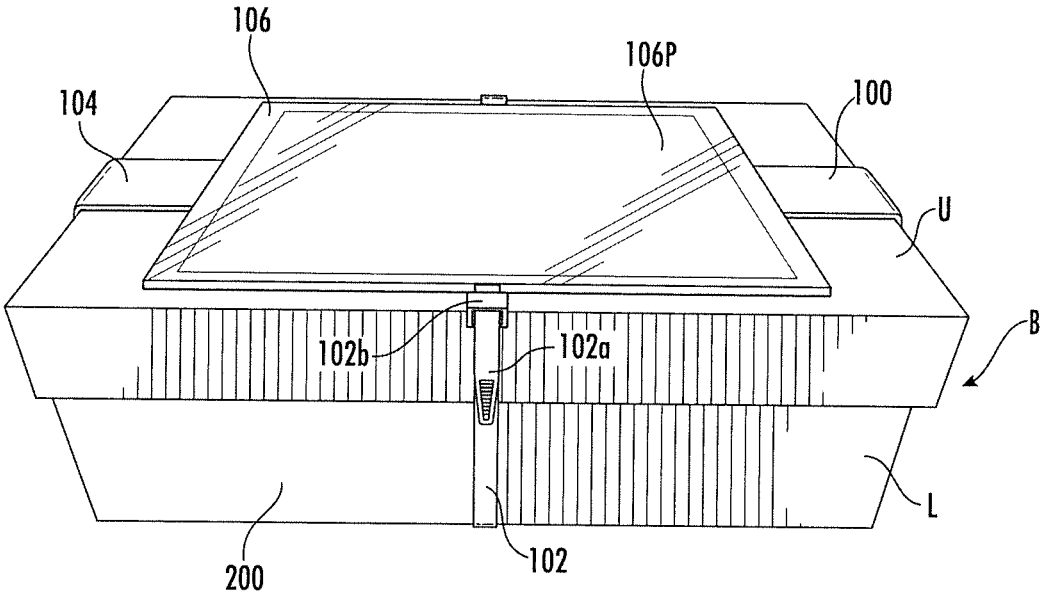
FIG. 5 is a perspective view of the system of FIG. 3 shown in a closed and locked state.

Once the packaging sealing device 100 is secured to a box B, removal of the packaging sealing device 100 is inhibited when the fastener 102 and the band 104 are secured around the box and the fastener 102 is locked as shown in FIG. 5. When the packaging sealing device 100 is secured to the box B, a portion of the fastener 102 is secured within the openings 104, 104*y* of the band 104 in an interlocking fashion and the fastener 102 has been adjusted to a size to approximate the size of the box, thereby inhibiting sliding of either the fastener 102 or the band 104 off from the box B.

The box B may be formed from biodegradable and/or compostable material. For example, the box B may be formed from mushroom-based and/or other plant-based materials. The sides of the box B and/or any constituent parts of the box B may be glued to facilitate forming the shape or configuration of the box B. The glue that is used may be water based.

The fastener 102 may include a locking mechanism that may include a buckle 102*b* that is configured to receive the distal end 102*a* of the fastener 102 therethrough and to secure a portion of the pulled through length of fastener within the buckle 102*b*, thereby closing the fastener 102 and adjusting the circumference or perimeter defined by the closed fastener 102. Preferably, once the fastener 102 is closed by passing the distal end 102*a* through the buckle 102*b*, the closed perimeter can be made smaller by pulling more of the length of material of the fastener 102 through the buckle 102*b* but cannot be made larger. That is, the buckle 102*b* permits pulling the length of material of the fastener 102 through the buckle 102*b* but prevents removal of the length of material back through the buckle 102*b*, thereby preventing opening of the fastener 102 once the fastener 102 is closed.

The band 104 may be an adhesive tape or the like that is configured to be secured to the box. Alternatively or additionally, the band 104 may be formed from an elastic material, e.g., a rubber band or the like such that the band 104 may accommodate the reception of boxes that have a range of sizes. For example, the band 104 may be biased toward a first size but may be stretched to a larger size such that the band 104 may be stretched to receive the box B lengthwise, along its length Y, and the band 100 will then approximate the size and shape of the box as it is biased back toward its initial size. Depending on the size of the box B that will be secured by the sealing device 100, the elasticity of the band 104 may be such that the band 104 is not so great as to permit pulling the band 104 over the corners or edges of the box B so that removal of the sealing device 100 is inhibited.

A labeling sleeve or pocket 106, which may receive paper(s) 106P such as mailing instructions or labels or the like. The labeling sleeve 106 may be coupled to the band 104 and/or the fastener 102 such that shipping information and the like may be contained and/or affixed thereto.

Figure 1:
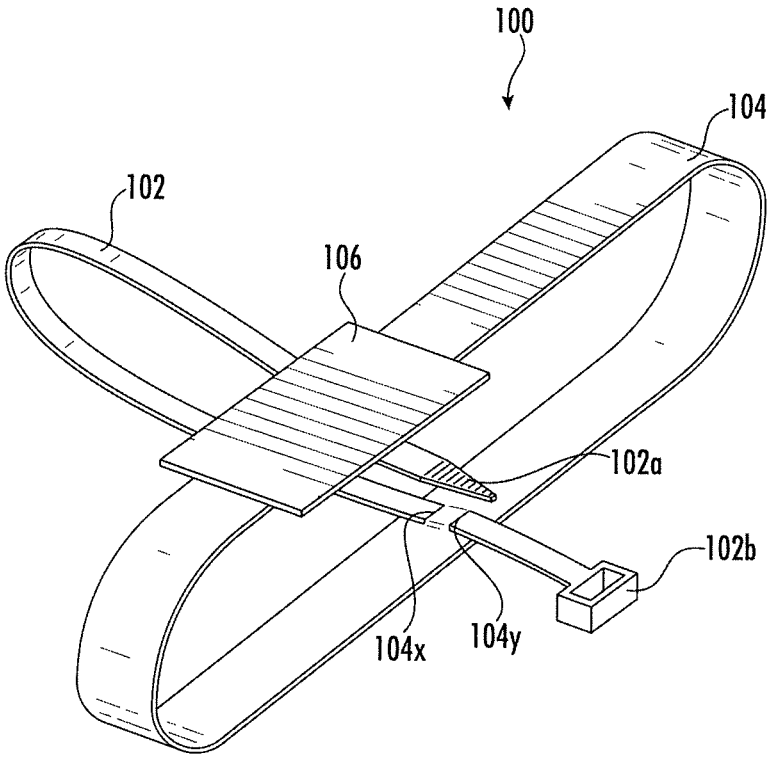
FIG. 1 is a perspective view of a packaging sealing device in accordance with the present disclosure.
Figure 2:
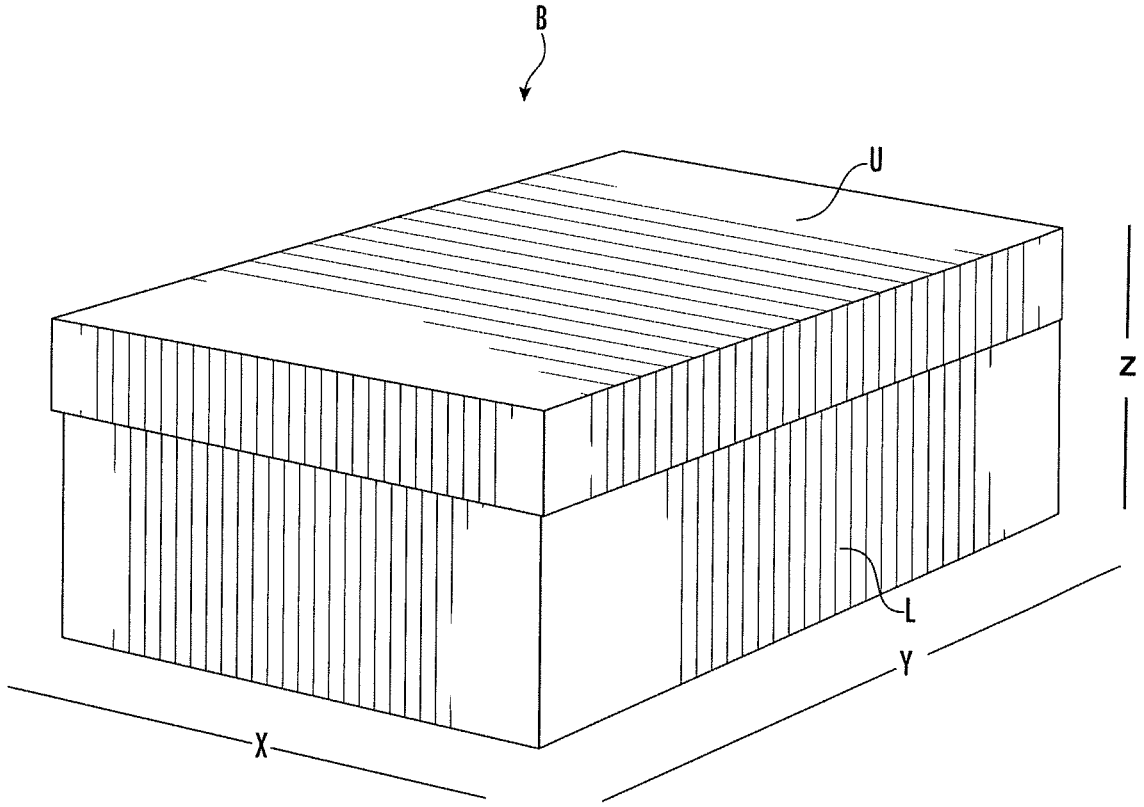
FIG. 2 is a perspective view of a box.

As shown in FIG. 2, a box or container B may define a width X, a length Y, and a height Z. The box B may include a lower section L, which is a receptacle that includes two pairs of opposing walls and lower surface, and a lid or cover U that removably fits around upper portions of the two pairs of opposing walls of the lower section such that when the lid or cover U is coupled with the lower section L the box or container B that they define has a generally rectangular prism shape. It is to be understood that the depicted box B as shown in FIG. 2 is not intended to be drawn to scale. For example, although the box B is shown as having a width X that is less than the length Y and that the height Z is shown as having a dimension that is smaller than either the width X or the length Y, the dimensions X, Y, Z may all have the same dimension (e.g., the box may be a cube) or may have any relative differences of dimensions (e.g., X may be greater than Y or Z; Y may be greater than X or Z; Z may be greater than X or Y or any other variation or combination). Also, while the box B is shown as being rectangular, the box may have any configuration or shape. For example, the box may be polygonal including a plurality of sides (e.g., a hexagonal prism). Also, while polygonal prisms are described as the shape of the box B, other shapes are also envisioned, such as curved or circular or oval-like shapes. Also, while the box B is shown as having a lid U that is separable from the lower section L of the box, other configurations are also within the scope and spirit of the present application. For example, the lid U may be hinged relative to or pivotably secured to the lower section L. It should be understood that the above discussed variations of the box are merely illustrative and not intended to restrict the disclosure to any particular box configuration and that it should be understood and obvious to one skilled in the art that the embodiments of the invention thus described may be further modified without departing from the spirit and scope of the disclosure.

Figure 3:
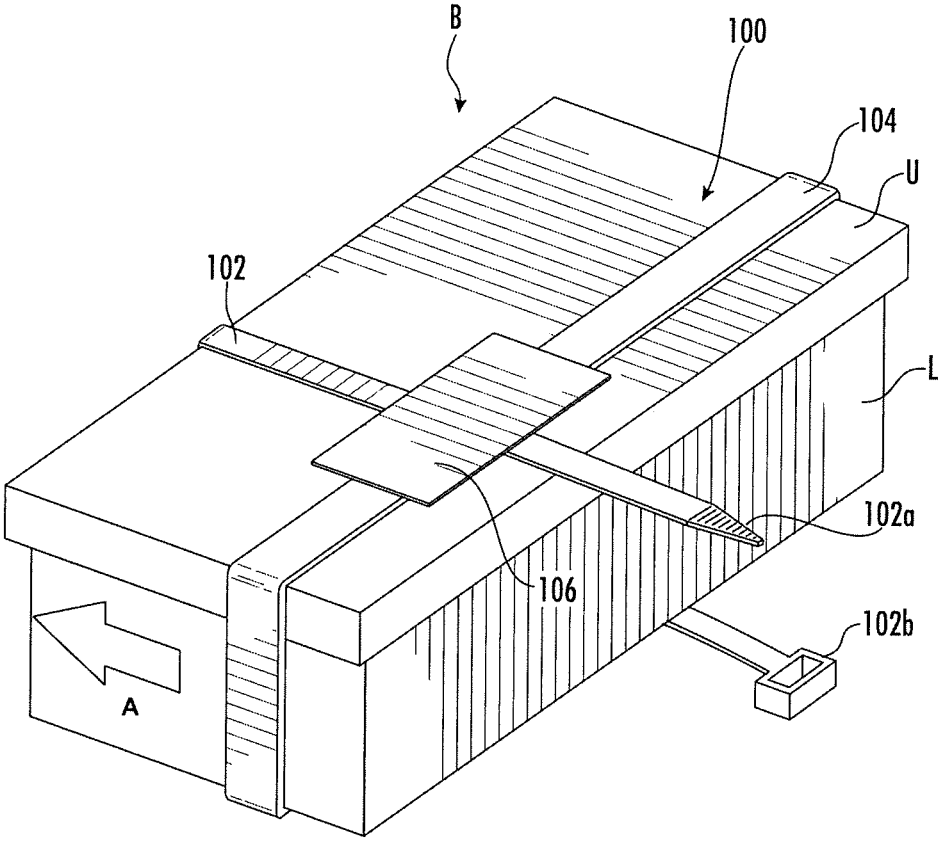
FIG. 3 is an illustration of a system that includes the packaging sealing device of FIG. 1 shown being placed on the box of FIG. 2 with the packaging sealing device shown in an unlocked state.
Figure 4:
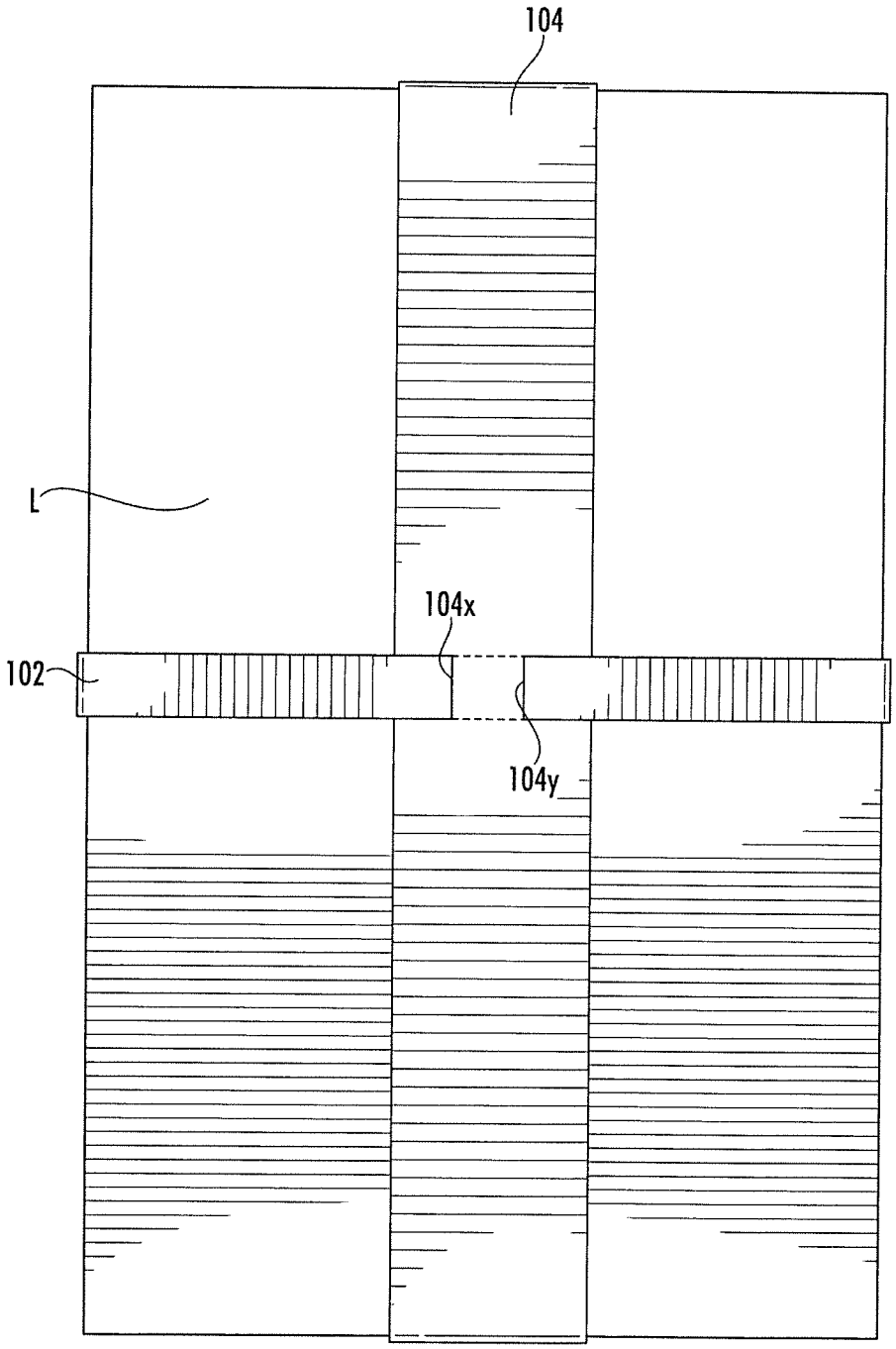
FIG. 4 is a bottom view of a bottom view of the system of FIG. 3.

As shown in FIG. 3, a packaging system 200 that includes the box B and the packaging sealing device 100 during placement of the packaging system 200 onto the box B.

Use of the packaging system 200 will now be described with respect to FIGS. 3-6.

As shown in FIG. 3, with the fastener 102 secured to the band 104, i.e., with the fastener 102 disposed within the first and second openings 104*x*, 104*y* of the band 104, the box B may be moved in a direction A by sliding the band 104 over the length Y of the box B and the fastener 102 can be pulled in a direction opposite that of direction A such that the band 104 is disposed roughly at a midpoint of the width X of the box B. The fastener 102 may be slid or pulled through the openings 104*x*, 104*y* of the band 104 until the band 104 is roughly at the midpoint along the width X of the box B. The material forming the fastener 102 and/or the band 104 may be configured to approximate or conform to the shape of the underlying box B to which the fastener 102 and the band 104 are to be coupled.

That is, the band 104 may be secured to the box B around its upper and lower surfaces and two of its opposing sides at opposite ends of the length Y. Once the band 104 is placed around the box B, the fastener 102 may be closed by pulling its distal end 102*a* through the buckle 102*b* until the fastener 102 approximates the box B. Preferably, once the fastener 102 is so secured, the fastener 102 is locked and cannot be removed without cutting the fastener 102 and/or the band 104 to permit removal of the packaging sealing device 100 from the box B. In FIG. 5, the box B is shown in a closed state and the packaging sealing device 100 is shown in a closed or locked state as the distal end or male member 102*a* of the fastener 102 is pulled through the female member or buckle 102*b* of the fastener 102.

The fastener 102 and/or the band 104 may be formed from the same or different materials. For example, the fastener may be formed from a plastic, a polymer, and/or a nylon material. Alternatively, or additionally, the fastener 102 may be formed from a stretchable or elastic material. The band 104 may be an adhesive tape such as a packaging tape and/or duct tape or the like. The band 104, alternatively, may be formed from a rubber, rubber-like, latex and/or elastomeric material such that the band 104 may be stretched over the box B to accommodate and approximate the shapes and contours of the box B. The fastener 102 and/or band 104 may be formed from renewable resources and/or may be biodegradable. For example, the fastener 102 and/or the band 104 may be formed from a natural rubber or natural latex, which are renewable and biodegradable materials.

Preferably, the fastener 102 may be formed from a material that can wrap around the box B but one that does not stretch in a lengthwise direction and the band 104 may be formed from a material that is stretchable within a range such that the band 104 may be stretched to have a snug fit with the box when it is placed around the box so that when placed on the box, the band 104 is substantially at the outer limit of its stretchablity so that the band 104 may not be further stretched and taken off of the box B once so secured. For example, the band 104 may be transitionable between a first dimension and a larger second dimension and when the band 104 is placed around the box B, the band 104 may be in the larger second dimension which may be roughly the maximum dimension to which the band 104 may be stretched and the band 104 may be biased toward the smaller first dimension. This is advantageous to inhibit removal of the band 104 once it is placed on the box B.

Figure 6:
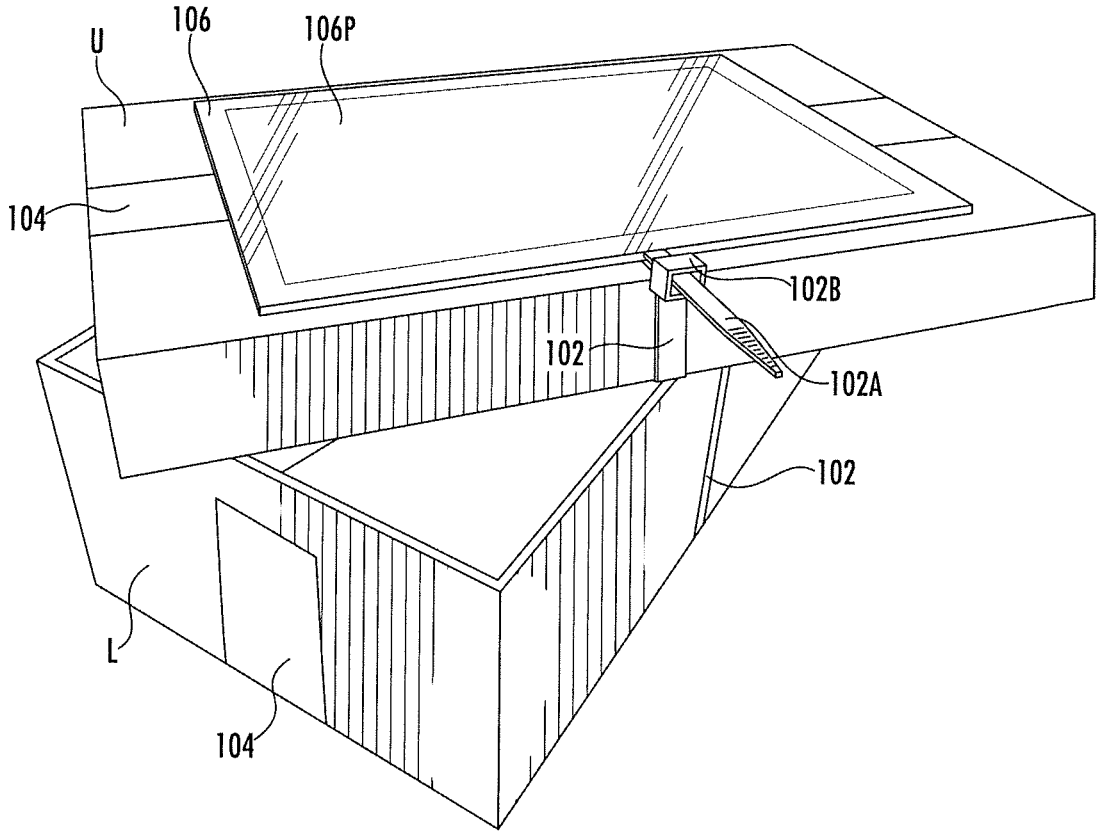
FIG. 6 is perspective view of the system of FIG. 3 shown in an open and unlocked state.

As shown in FIG. 6, both the fastener 102 and the band 104 have been cut, thereby permitting separating the lid U from the receptacle L of the box B. Once the band 104 is placed on the box B and the fastener 102 is tightened around the box in a direction orthogonal relative to that of the band 104 (as shown in the figures), removal of the sealing device 100 may be inhibited without cutting either the band 104 or the fastener 102, thereby providing a tamper proof or evident sealing means.

Preferably, the materials that form the packaging sealing device 100 and the packaging system 200 including each of their constituent elements (e.g., the box B), may be formed from entirely biodegradable and/or compostable materials. In addition, any adhesives or glues that are used to form the packaging sealing device 100 and the packaging system 200 including each of their constituent elements (e.g., the box B), may be water-based.

Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A packaging sealing device, comprising:

a band configured to be secured around a box in a first direction of the box;

a cable tie fastener that includes a length of material that includes male member at a distal end of the length of material and a female member secured to a portion of the length of material, the male member being configured to be secured to the female member such that the length of material is tightenable about the box in a second direction that is orthogonal relative to the first direction, wherein the band includes a first opening and a second opening, the length of material of the cable tie fastener being received through the first opening and the second opening, thereby securing the length of material of the cable tie fastener to the band; and a transparent sleeve that is coupled to at least one of the band and the cable tie fastener.

2. A packaging system, comprising:

a container generally defining a rectangular prism configuration, the container comprising:

a receptacle including five walls and an opening; and a lid that includes a first wall that is configured to cover the opening and four remaining walls that fit around four of the five walls of the receptacle, wherein the container defines a lengthwise direction and widthwise direction;

a packaging sealing device comprising:

a band configured to be secured around a box in a first direction of the box; and a cable tie fastener that includes a length of material that includes male member at a distal end of the length of material and a female member secured to a portion of the length of material, the male member being configured to be secured to the female member such that the length of material is tightenable about the box in a second direction that is orthogonal relative to the first direction, and wherein the band includes a first opening and a second opening, the length of material of the cable tie fastener being received through the first opening and the second opening, thereby securing the length of material of the cable tie fastener to the band.

3. The packaging system of claim 2, wherein:

the band includes a first opening and a second opening; and a portion of the length of material of the cable tie fastener extends through the first opening and the second opening of the band with the portion of the length of material of the cable tie fastener being substantially orthogonal relative to a portion of the band through which the first opening and the second opening are disposed.

4. The packaging system of claim 2, wherein:

the band is transitionable from a first dimension to a second dimension, the second dimension substantially approximating a girth of the box, wherein the band is substantially at a maximum dimension when in the second dimension, the band being biased toward the first dimension, the first dimension being less than the second dimension.

5. The packaging system of claim 1, wherein:

the length of material of the cable tie fastener is substantially inelastic in a lengthwise direction.

* * * * *